US005090545A

United States Patent [19]

Nassar

[11] Patent Number: 5,090,545

[45] Date of Patent: Feb. 25, 1992

[54] SCREW GUN NOSE CONE ADAPTER

[76] Inventor: Alan E. Nassar, G-6 Foxtail La., Goffstown, N.H. 03045

[21] Appl. No.: 604,116

[22] Filed: Oct. 25, 1990

[51] Int. Cl.[5] ..... F17D 23/00

[52] U.S. Cl. ..... 192/34; 81/438; 279/1 A

[58] Field of Search ..... 192/34; 81/438, 442; 279/1 A

[56] References Cited

U.S. PATENT DOCUMENTS

| | | | |
|---|---|---|---|
| 1,413,101 | 4/1922 | Cushing | 81/438 X |
| 1,824,623 | 9/1931 | Robertson | 81/438 X |
| 2,857,997 | 6/1956 | Garybill | 192/34 |
| 2,950,626 | 8/1960 | Short | 74/333 |
| 3,023,015 | 2/1962 | Pankow | 279/1 A |
| 3,843,143 | 10/1974 | Laxson | 279/1 A |
| 4,159,050 | 6/1979 | Hopkins, Sr. et al. | 192/34 |
| 4,804,048 | 2/1989 | Porth, Jr. | 173/47 |
| 4,944,641 | 7/1990 | Alves | 279/1 A |

FOREIGN PATENT DOCUMENTS

| | | | |
|---|---|---|---|
| 3604927 | 8/1987 | Fed. Rep. of Germany | 279/1 A |

*Primary Examiner*—Leslie A. Braun

*Assistant Examiner*—Nicholas Whitelaw

*Attorney, Agent, or Firm*—Davis, Bujold & Streck

[57] ABSTRACT

An adapter device for attachment to a drive member having a clutch biased into disengagement for converting that drive member into a positive rotational drive member. The adaptor device comprising an outer casing having first and second opposed openings and a slot in a sidewall of the outer casing, the second opening having an interior thread for engaging an exterior threaded portion of the drive member. A drive shank having a first end thereof for engaging a rotatable member and a second end thereof for engaging a drive end of the drive member is supported by the outer casing. A bearing is provided in a recessed area of the drive shank and the bearing is connected, via a collar, with a handle extending through the slot in the outer casing to facilitate operation of the device wherein, when the handle is in a first stationary position, the drive shank causes continuous engagement of the clutch and, when the handle is in a second stationary position, the drive shank allows disengagement of the clutch but may cause engagement of the clutch when biased in a direction toward the clutch.

20 Claims, 3 Drawing Sheets

SCREW GUN NOSE CONE ADAPTER

BACKGROUND OF THE INVENTION

The present invention relates to an adapter device which can be used to convert a conventional screw gun, which has a spring biased clutch that must be engaged before the screw gun will transmit rotational motion from its motor to its output drive member, into a continuously positively rotatable cutting or drilling tool and back to a screw gun in a quick and easy manner thereby eliminating the need for a separate drill or cutting tool.

Conventional power tools which perform typically only one function, either screwing or cutting, have been know in this art for quite sometime. Examples of screwing devices, for instance, are shown in U.S. Pat. Nos. 2,857,997, 2,950,626, 4,159,050 and 4,804,048. Such tools allow the drive member to slip when a desired tightening torque has been attained by the driven member (such as a screw or bolt) being embedded However, such tools do not eliminate the need for the operator to carry both a screw gun and a drill or cutting tool, especially when such operator is installing drywall or the like.

Presently, an installer of drywall typically employs a screw gun for securing the drywall to the framework along with a drywall cutout tool which is specifically designed for making cutouts in the drywall for electrical boxes, window openings, splices, etc. The present invention is directed at modifying a conventional screw gun, through the use of a nose cone adapter, so that the screw gun can function both as a drive tool and as a drywall cutout device in a quick and relatively inexpensive and efficient manner.

Wherefore, it is an object of the invention to provide a nose cone adapter device for a screw gun which is attachable to the drive end of the screw gun for readily converting the screw gun into a cutting member and back to a screw gun by merely moving the operational handle of the nose cone adapter device from one stationary position to another stationary position.

A further object of the present invention is to provide an adapter device which is relatively simple to manufacture, install and operate.

A still further object of the invention is to provide an adapter device which can readily receive a variety of cutting, driving and drilling components.

Another object of the invention is to provide an adaptor device which facilitates removal and insertion of the cutting, driving and drilling components.

The above and other objects and advantages of the present invention will become apparent to those skilled in the art by having reference to the following description in attached drawings.

SUMMARY OF THE INVENTION

Briefly, the present invention relates to an adapter device for attachment to a drive member having a clutch biased into disengagement for readily converting that drive member into a positive rotational drive member as desired, said adapter device comprising an outer casing having first and second opposed openings and at least one slot in a sidewall of said outer casing, the second opening having means for engaging a drive end of the drive member to attach the adapter device thereto;

a drive shank having a first end carrying means to engage a member to be driven and a second end thereof having means for engaging the drive end of the drive member, said drive shank having means for engaging bearing means in a central portion thereof; and bearing means for engaging said bearing engaging means provided in the central portion of said drive shank to allow the drive shank to rotate relative to said outer casing, and at least one handle means connected to said bearing means, said at least one handle means extending through said at least one slot in the outer casing to facilitate operation of the device, wherein said adapter device, when attached to the drive member, facilitates continuous engagement of the clutch of the drive member when the handle means is moved to a first stationary position along said slot.

BRIEF DESCRIPTION OF THE DRAWINGS

The present invention will now be described, by way of example, to the accompanying drawing in which.

DESCRIPTION OF THE PREFERRED EMBODIMENT

Figure 1:
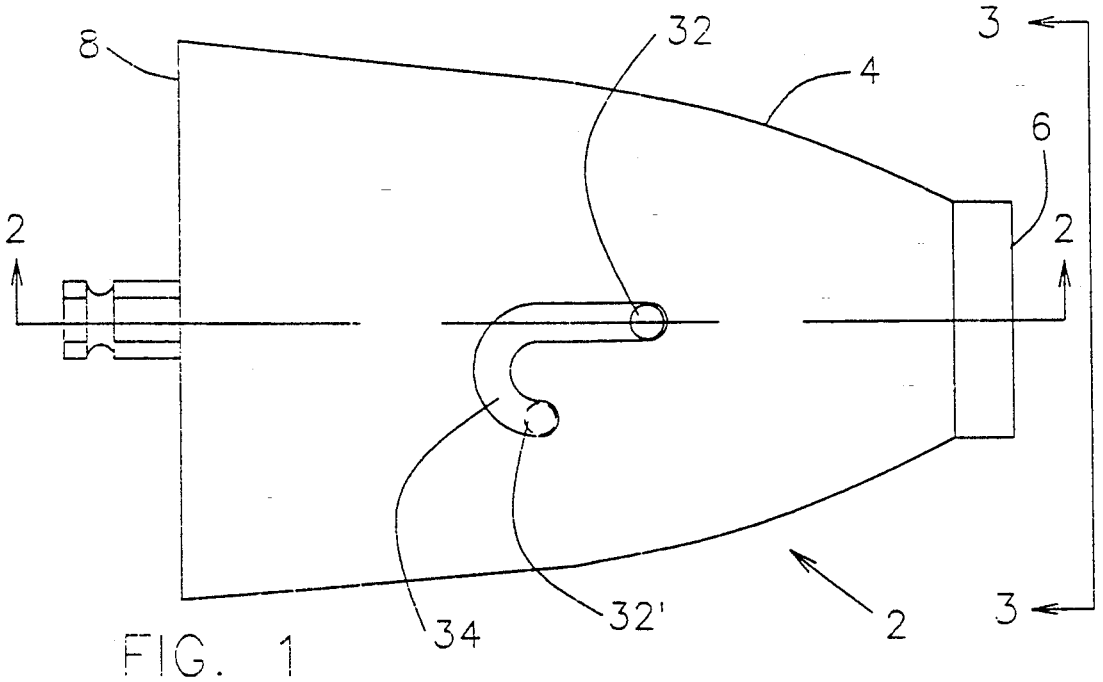
FIG. 1 is a front elevational view of the nose cone adapter according to the present invention.
Figure 2:
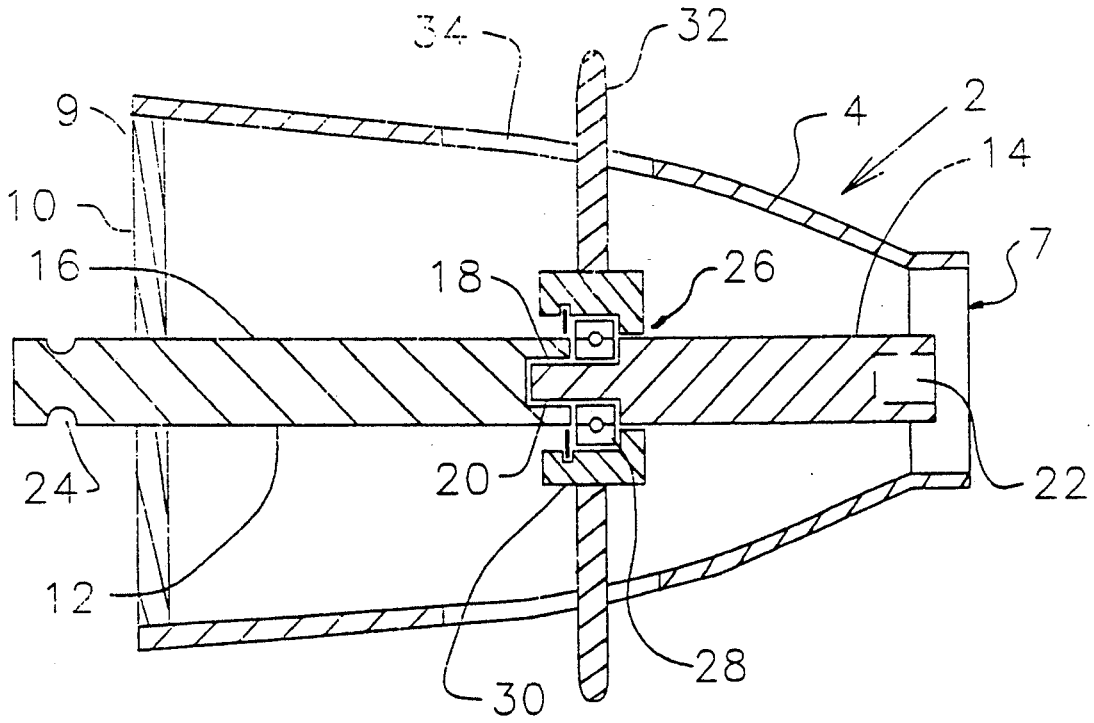
FIG. 2 is a cross-sectional view of the nose cone adapter of FIG. 1 along section line 2—2.

With reference to FIGS. 1 and 2, the novel features of the adapter device of the present invention will now be described in detail. The adapter device 2 comprises an outer casing 4 which has a generally curved exterior surface or profile that tapers toward a first end 6 to define a first (small) circular opening 7 and flares toward an opposite end 8 to define a second (large) circular opening 9 An internal thread 10 is provided adjacent the flared end 8 for engaging an exterior thread 50 of the drive end of a screw gun 36 (see FIG. 4) to secure the adapter device in an operational position. A locking ring or collar (not shown) can be used to releasable lock the device 2 in a desired position along the drive axis A of the screw gun. The outer casing can be manufacture from plastic, aluminum or other durable, lightweight materials. Rotatably secured inside the adapter device 2 is a drive shank 12 for transmitting rotational energy from the screw gun to a screw tip, a drill or a cutting bit, or other low speed (about 400 rpm or less) rotational driven member 48 attached to the drive end of the shank. The drive shank 12 comprises first and second shank members 14, 16, respectively, which are hexagonally shaped members having a diameter of about ½ inch. The shank members 14, 16 are connected together by engagement of a threaded portion 18, located on a first end of the first shank member 14, with a threaded bore 20, located on a first end of the second shank member 16. The threaded portion and the threaded bore are both provided with a mating left-handed thread which tightens the connection between the two shanks components upon clockwise rotation C of the drive shank 12 (see FIG. 4). The opposite end of the first shank member 14 is provided with a receiving aperture 22 which releasably supports the driven member 48, such as a screw tip, a drill bit, a cutting member or the like. The receiving aperture 22 preferably has a hexagonal shape with a diameter of about ¼ inches and the driven member 48 has a slightly smaller hexagonal shape which allows that member to be received within the aperture 22. The interior of the receiving aperture may be provided with a spring biased member, such as a snap ring or a small ball positioned in the sidewall of the aperture biased inwardly against a small indentation in the driven member 48 by a spring (not shown), for releasably retaining the screw tip, drill bit or cutting or driven member 48 when positioned in the aperture 22. The second end of the second shank 16 is provided with engaging end 24 for releasably engaging the drive output 40 of the screw gun 36, and such engaging end is conventional in this art and thus not discussed further.

A recessed area 26 is formed in the middle section of the drive shank 12 adjacent the connection between the first and second shank members 16, 18 As can be seen in FIG. 2, the recessed area 26 is formed by an unthreaded portion of the threaded portion 18 so that when the threaded portion is completely threaded into the threaded bore 20, the first and second shank members are spaced from one another by the unthreaded portion to form the recessed area 26.

Figure 3:
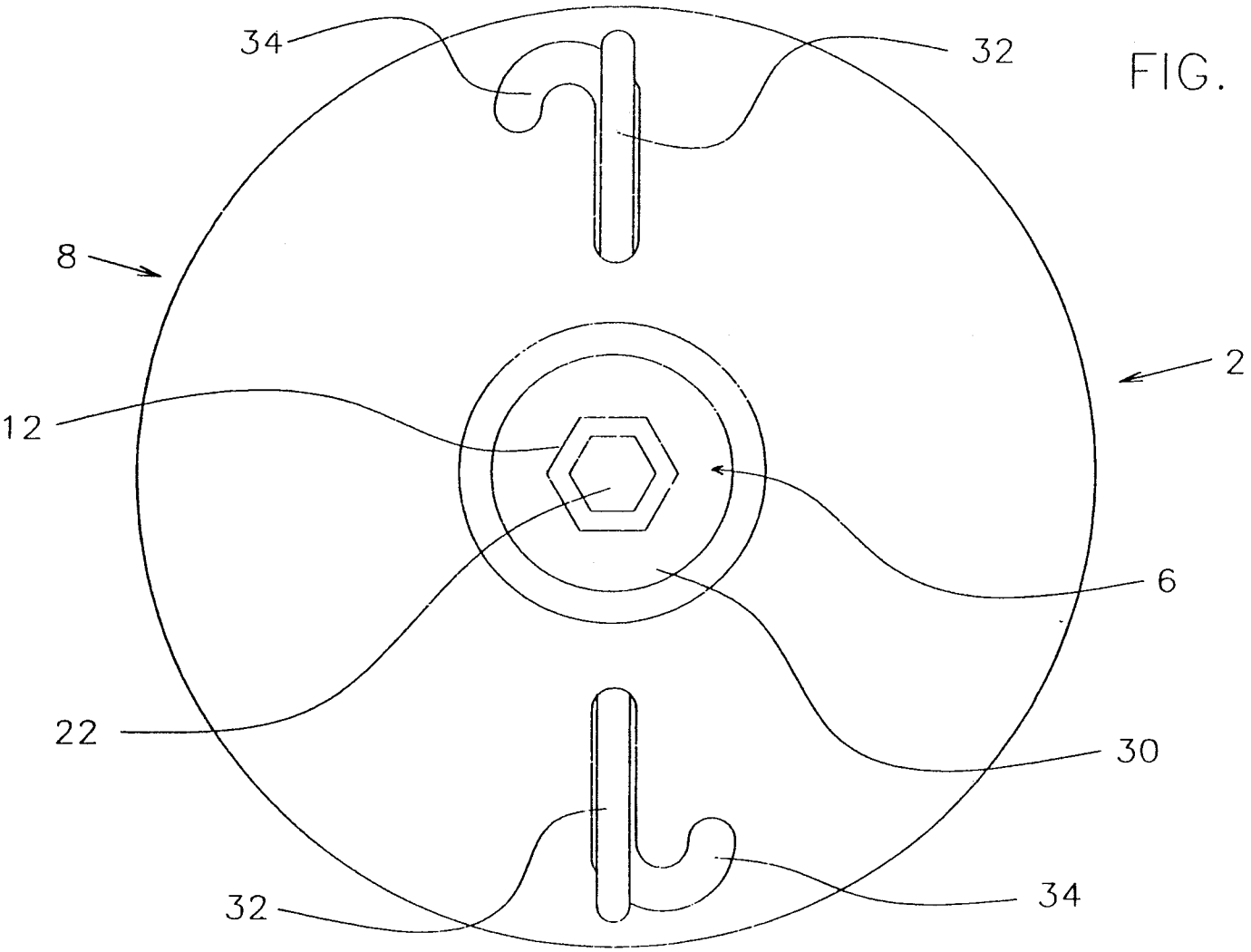
FIG. 3 is an end view of the nose cone adapter of FIG. 1 in the direction of arrow 3—3.

The recessed area 26 is encompassed by a bearing 28 which, in turn, is supported by a collar 30, in combination with a C-shaped snap ring 31, having latching or handle means 32 attached to the exterior surface of the collar 30. The bearing contacts the surface of the second shank member partially defining the recess area 26 and may also contact the unthreaded portion. This connection allows the drive shank to rotate relative to the outer casing 4 in a relatively unrestricted manner. It is to be appreciated that one, two or three or more equally spaced handle means may be attached to the collar 30, two of which are shown in FIG. 3. Each handle means extends out through a J-shaped aperture or slot 34 in the outer casing 4. The handle means facilitates movement of the drive shank 12 relative to the outer casing 4 into a stable first position and the purpose of such movement will be described in detail hereinafter.

It is to be appreciated that the drive member 12 could also be formed of a single, unitary member having recessed area 26 formed, by machining or the like, in the central section of the shank. In such an arrangement, a split bearing 28 and a split collar 30 could be utilized to engage the drive shank 12.

A variety of different arrangements are conceivable for connecting the drive shank 12 to the outer casing 4 while still allowing the drive shank to rotate relative to the outer casing. The above described arrangement is only a preferred embodiment of the invention. Such other arrangements are also considered to be within the spirit and scope of the present invention.

Figure 4:
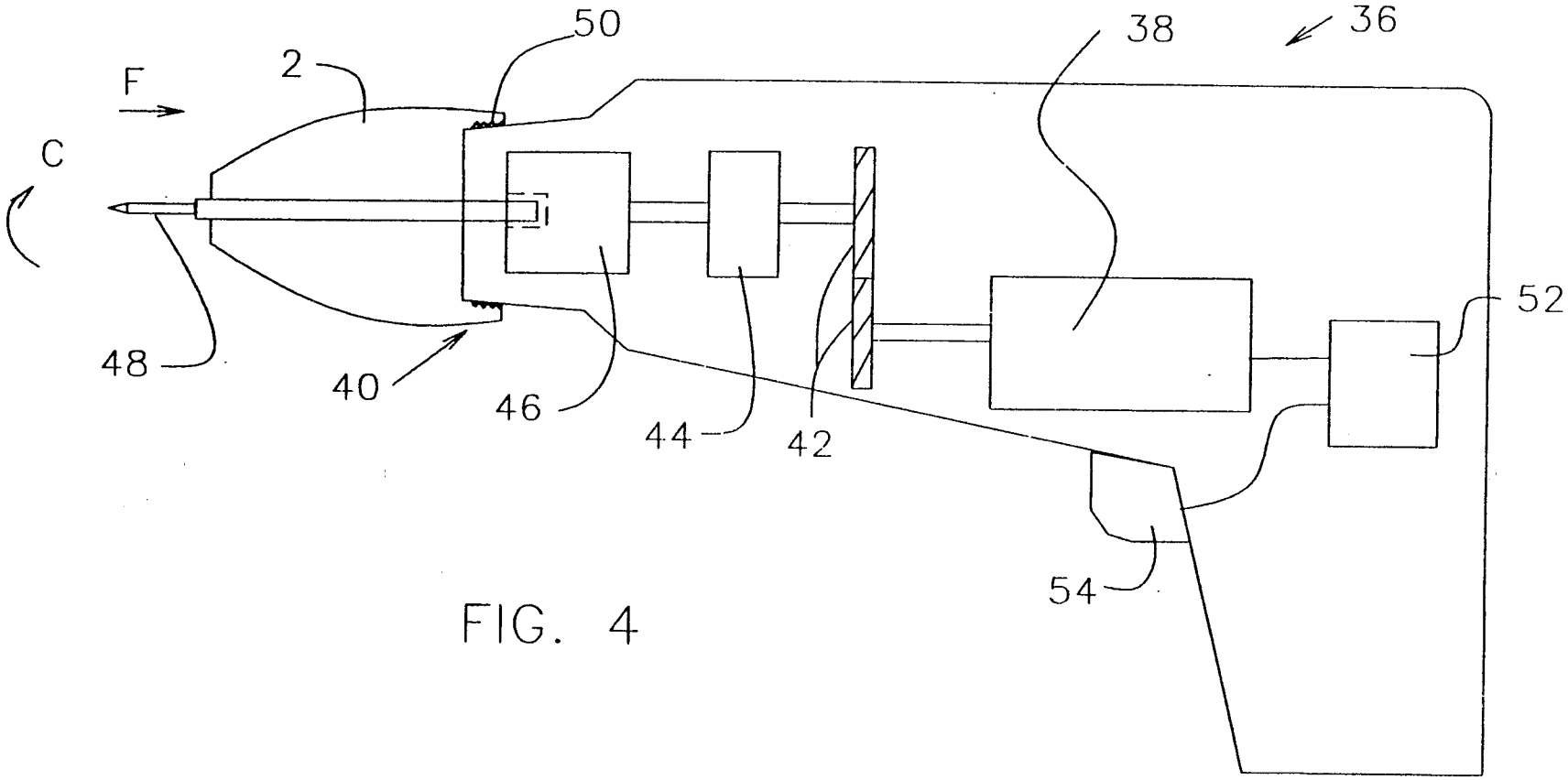
FIG. 4 is a diagrammatic view showing the attachment of the nose cone adapter to a screw gun drive member.

In FIG. 4, a conventional screw gun 36 is shown diagrammatically and it comprising a motor 38, activated by a power source 52 and switch 54, for transmitting rotational energy to the drive output 40 of the screw gun via a plurality of gears 42 and a spring biased clutch 44. The drive output 40 of the screw gun 36 is provided with a receiving aperture 46, also of hexagonal shape with a diameter slightly larger than ½ inch or so, which releasably engages the engaging end 24 of the adapter device 2 so that, once connected therewith, the motor 38 will transmit rotational energy via the gears 42 and the clutch 44, after engagement, to the drive shank 12. When the adapter device 2 is in the position shown in FIG. 2, it merely functions as an extension of the drive output 40 and an inward force, in the direction of arrow F, is required for engagement of the clutch 44 to allow rotational energy to be transmitted to the drive member 12.

Once the adapter device is appropriately installed by engaging the internal thread 10 with external thread 50 of the screw gun, the adapter device 2 can thereafter be used to readily convert the screw gun into a positive rotational drive member for operating as a drilling or cutting device. The conversion is achieved by sliding the handle means 32 along the J-shaped slot(s) 34 into a first position depicted in FIG. 1 by dashed line 32'. When the handle means 32 is so positioned, the handle means 32, via the collar 30 and the bearing 28, force the drive shank 12 in the direction of arrow F toward the motor 38 and thereby compress the spring(s) of the clutch 44. The spring(s) of the clutch, in turn, biases the handle means 32 against the second end of the slot 34 and locks the handle means 32 in that position. The clutch 44 continuously transmits rotational energy from the motor 38 to the drive shank 12 of the adapter device 2 so long as the handle means is in the first position. Thus, if a cutting member or drill bit 48 is received by receiving aperture 22, that member or bit can be used for drilling a hole or cutting an opening in drywall or the like for an electrical outlet, a light switch or other device It is to be appreciated that axial movement of the adapter device, relative to the screw gun, by releasing the locking collar and rotating the device in one direction or the other allows fine tuning adjustment of the clutch engagement.

When operation of the tool as a screw gun is desired, the operator slides the handle means initially in the direction of arrow F and then slightly clockwise along the J-shaped slot(s) 34 into a second stable position, shown by solid line 32 in FIG. 2, so that the clutch is allowed to be disengaged by its spring(s).

Since certain changes can be made in the above described adapter device without departing from the spirit and scope of the invention herein involved, it is intended that all subject matter contained in the above description and shown in the accompanying drawings shall be interpreted as merely being illustrative of the present inventive concept and shall not be construed as limiting the invention herein involved.

Wherefore, I claim:

1. An adapter device, for attachment to a drive member having a clutch biased into disengagement for converting that drive member into a continuous positive rotational drive member, said adapter device comprising:

an outer casing having first and second opposed openings and at least one slot in a sidewall of said outer casing, the second opening having means for engaging a drive end of the drive member for attaching the adapter device to the drive member;

a drive shank having a first end carrying means for engaging a member to be driven and a second end having means for engaging a drive output of the drive member; and bearing means, provided in a portion of said drive shank intermediate its first and second ends, for supporting said drive shank and allowing the drive shank to rotate relative to said outer casing, and at least one handle member connected to said bearing means, said at least one handle member extending through said at least one slot in said outer casing to facilitate operation of the adapter device, wherein said adapter device, when attached to the drive member, facilitates continuous engagement of the clutch of the drive member when the handle member is moved along said slot to a first stationary position.

2. The adapter device according to claim 1, wherein, when said adapter device is attached to the drive member, the first stationary position is adjacent an end of said slot adjacent the drive member, and when said at least one handle member is moved along said slot into a second stationary position, adjacent a second end of said slot remote from the drive member, said adapter device allows disengagement of the clutch.

3. The adapter device according to claim 1, wherein said bearing means comprises a recessed area in a central portion of said drive shank accommodating a bearing and a collar, connected to the at least one handle member, encasing the bearing.

4. The adapter device according to claim 1, wherein said at least one slot in the outer casing has a generally J-shaped configuration which extends substantially along a longitudinal axis of the adapter device.

5. The adapter device according to claim 1, wherein said means for engaging the driven member comprises a hexagonal shape aperture.

6. The adapter device according to claim 1, wherein said drive shank comprises first and second shank members which are threadingly connected to one another by a mating reverse thread.

7. The adapter device according to claim 1, wherein said outer casing has two J-shaped slots, each extending substantially along a longitudinal axis of the adapter device, and at least two spaced apart handle members are connected to said bearing means, each said handle member extends through one of said J-shaped slots.

8. The adapter device according to claim 7, wherein said two handle members are connected to a collar which encases the bearing means.

9. The adapter device according to claim 1, wherein said outer casing has a curved conical profile tapering from the second opening toward the first opening.

10. The adapter device according to claim 1, wherein said adapter device is used in combination with a screw gun.

11. The adapter device according to claim 1, wherein said means for engaging drive end of the drive member is an internal thread.

12. The adapter device according to claim 1, wherein said drive shank comprises a unitary member having a hexagonal shape cross-section.

13. An adapter device for attachment to a drive member having a clutch biased into disengagement for converting that drive member temporarily into a continuous positive rotational drive member as desired, said adapter device comprising:

an outer casing having first and second opposed openings and at least one slot in a sidewall of said outer casing, the second opening having means for engaging a drive end of the drive member for attaching the adapter device to the drive member, and said outer casing having an exterior surface tapering from the second opening toward the first opening;

a drive shank having a first end carrying a hexagonal shaped aperture to engage a member to be driven and a second end thereof having means for engaging the drive end of the drive member, and said drive shank having a recessed area in a central portion thereof; and bearing means for engaging and supporting said recess area of said drive shank and allowing the drive shank to rotate relative to said outer casing, and at least one handle member connected to said bearing means, said at least one handle member extending through said at lest one slot in the outer casing to facilitate operation of the adapter device, wherein said adapter device, when attached to the drive member, facilitates continuous engagement of the clutch of the drive member when the handle means is moved along said slot to a first stationary position.

14. The adapter device according to claim 13, wherein, when said adapter device is attached to the drive member, the first stationary position is adjacent an end of said slot adjacent the drive member, and when said at least one handle member is moved along said slot into a second stationary position, adjacent a second end of said slot remote from the drive member, said adapter device allows disengagement of the clutch.

15. The adapter device according to claim 13, wherein said at least one slot in the outer casing has a generally J-shaped configuration which extends substantially along a longitudinal axis of the adapter device.

16. The adapter device according to claim 13, wherein said drive shank comprises first and second shank members which are threadingly connected to one another by a mating reverse thread.

17. The adapter device according to claim 13, wherein said bearing means comprises a collar encompassing a bearing supported in the recessed area of said drive shank, and the collar is connected to said at least one handle member.

18. The adapter device according to claim 13, wherein said adapter device is used in combination with a screw gun.

19. The adapter device according to claim 13, wherein said means for engaging drive end of the drive member is an internal thread.

20. An adapter device, for attachment to a drive member having a clutch biased into disengagement for converting that drive member into a continuous positive rotational drive member, said adapter device comprising:

an outer casing having first and second opposed ends, the second end having means for engaging a drive end of the drive member for attaching the adapter device to the drive member;

a drive shank, defining an axis, having a first end carrying means for engaging a member to be driven and a second end carrying means for engaging a drive output of the drive member;

bearing means, interacting with said outer casing via a handle member connect to said bearing means, for supporting said drive shank and allowing the drive shank to rotate relative to said outer casing, said drive shank being axially movable relative to at least a portion of said outer casing, via the handle member, into first and second positions wherein, when said adapter device is attached to the drive member and the drive shank is in the first position, said drive shank causes continuous engagement of the clutch of the drive member and, when said drive shank is in the second position, said drive shank allows the clutch of the drive member to become disengaged but is movable in a direction of the clutch to cause engagement of the clutch, and means for releasably securing said drive shank in the first position.

* * * * *